US006070749A

United States Patent [19]

Joulia

[11] Patent Number: 6,070,749

[45] Date of Patent: Jun. 6, 2000

[54] CASE, OF THE MAKE-UP CASE TYPE

[75] Inventor: Gerard Joulia, Paris, France

[73] Assignee: L'Oreal, Paris, France

[21] Appl. No.: 09/173,679

[22] Filed: Oct. 16, 1998

[30] Foreign Application Priority Data

Oct. 23, 1997 [FR] France ..... 97 13303

[51] Int. Cl.[7] ..... B65D 6/28; A45D 33/26

[52] U.S. Cl. ..... 220/4.22; 220/4.24; 220/817; 220/835; 220/840; 206/581; 132/294; 132/301

[58] Field of Search ..... 220/810, 811, 220/816–818, 820, 833–836, 840–842, 4.22, 4.23, 4.24, 4.21, 845, 847, 848; 16/224; 206/581, 235, 823; 132/293–295, 300, 301, 315

[56] References Cited

U.S. PATENT DOCUMENTS

| | | | |
|---|---|---|---|
| 1,688,042 | 10/1928 | Gaess | 220/4.22 |
| 3,008,177 | 11/1961 | Wooten, Jr. | 16/224 |
| 3,072,280 | 1/1963 | Spadaro | 220/4.22 |
| 3,152,716 | 10/1964 | Feldhahn . | |
| 3,476,123 | 11/1969 | Flax | 132/293 |
| 3,710,761 | 1/1973 | Gregory | 220/4.22 X |
| 4,109,821 | 8/1978 | Lutz | 16/224 |
| 4,589,431 | 5/1986 | Yuhara | 132/293 |
| 4,807,773 | 2/1989 | Tsai . | |
| 5,076,460 | 12/1991 | Hussell . | |
| 5,205,413 | 4/1993 | Cautereels et al. | 220/4.22 X |
| 5,577,628 | 11/1996 | O'Neil et al. | 220/840 |
| 5,596,789 | 1/1997 | Simioni | 16/224 |
| 5,878,878 | 3/1999 | Wu | 220/4.22 X |

FOREIGN PATENT DOCUMENTS

| | | |
|---|---|---|
| 0 061 251 | 9/1982 | European Pat. Off. . |
| 626 085 | 8/1927 | France . |
| 932 902 | 4/1948 | France . |

OTHER PUBLICATIONS

Patent Abstracts of Japan, vol. 096, No. 010, Oct. 31, 1996 and JP 08 150013 A (Yoshino Kogyosho Co. Ltd.), Jun. 11, 1996.

*Primary Examiner*—Nathan J. Newhouse
*Attorney, Agent, or Firm*—Oblon, Spivak, McClelland, Maier & Neustadt, P.C.

[57] ABSTRACT

A makeup case is composed of a bottom (2) and a lid (4) which is hinged to the bottom and can be reversibly locked against the said bottom. The bottom and the lid are formed from identical molded parts. A joint structure is designed to be used interchangeably for hinging the bottom to the lid or for reversibly locking the lid against the bottom. The hinging of the bottom to the lid and the reversible locking of the lid against the bottom are provided by mechanical snap-fastening at the joint structure.

10 Claims, 5 Drawing Sheets

CASE, OF THE MAKE-UP CASE TYPE

BACKGROUND OF THE INVENTION

1. Field of the Invention

The invention relates to a case, of the make-up case type, composed of at least two parts hinged to each other about a pivot pin. The invention relates in particular to a case composed of a bottom which defines a receptacle for the product and a lid hinged to the bottom. By way of example, such cases are particularly suitable for certain cosmetic products such as foundations, eye-shadows, poured or compacted powders, etc., but they may also be used to hold an object or may be used as a pill box.

2. Description of the Related Art

There are many types of hinging for such cases. A first hinging system commonly used is described, for example, in FR-A-2,546,386 in which the case consists of a bottom, an intermediate support plate bearing the product, and a lid, these being manufactured respectively by injection molding a thermoplastic and being hinged to each other by a hinge having an attached metal pin. Such a construction has the drawbacks of requiring an operation to fit this pin, and therefore of increasing the manufacturing time and the manufacturing cost. In addition, the case according to FR-A-2,546,386 includes a closing/opening system which further complicates the fitting operation.

Moreover, from JP-A-8 150013, there is known a make-up case whose bottom is hinged to the lid so as to permit opening the case from its front side or from its rear side. This case has a complicated structure, especially two attached clasps which are difficult to adjust and are expensive to manufacture and to fit.

Furthermore, U.S. Pat. No. 3,152,716 describes a case made of expanded polystyrene having a bottom and a lid of identical shapes. A magnet and a piece of magnetizable metal are placed in each—the bottom and the top—at opposite ends, so that at each end of the case, in the closed position, the magnet of the bottom interacts with the magnetizable piece of the lid and the magnet of the lid interacts with the magnetizable piece of the bottom. This case can be opened either end, in each case the end opposite the open end acting as a hinge. This case has the drawback that this kind of hinge does not function in a precise manner. Furthermore, the manufacturing costs of this case are high.

Hinged cases have the advantage of being relatively simple. However, the hinging of the lid to the bottom is generally rudimentary, the angle of opening being limited and having only the single function of rotating the lid with respect to the bottom. Moreover, the play in the operation of these hinging mechanisms generally increases with their use.

SUMMARY OF THE INVENTION

It is therefore an object of the present invention to provide a case, of the make-up case type, which does not have the drawbacks mentioned above with reference to the conventional devices, especially with regard to the structure of the hinging mechanism, to the structure of the opening/closing system and, more particularly, to the operation.

Another object of the present invention is to provide a case which does not require a pivot pin to be fitted.

It is another object of the invention to provide a case whose mechanism for hinging, the lid to the bottom is simple and economic to produce, this hinging mechanism serving, selectively, as a locking system for opening/closing the case or as a hinge.

It is yet another object of the invention to provide a case consisting only of two parts which are simple to produce and to fit, and the manufacturing cost of which is as low as possible.

According to the present invention, these and other objects are achieved by a case composed of a bottom and a lid hinged to the bottom, it being possible for the lid to be reversibly locked against the bottom. The bottom and the lid are formed from identical molded parts. First means and second means are able to be used interchangeably for hinging the bottom to the lid or for reversibly locking the lid against the bottom. According to the invention, the hinging of the bottom to the lid and the reversible locking of the lid against the bottom are provided by the first means being brought into engagement with the second means by mechanical snap-fastening.

The fact that the bottom and the lid have strictly the same shape is economically highly advantageous, since molding the lid and the bottom requires only a single mold, this mold being designed so that the balls and the corresponding housings can be integrally molded with the lid (or the bottom).

Thus, the first means have a first member whose first end is integral with the bottom and whose second end forms a first hinging element which can be removably inserted into a first recess made in the lid. The first recess is such that, when the first means are used for hinging the lid to the bottom, the lid can pivot through at least 90° with respect to the bottom. The said second means have a second member whose first end is integral with the lid and whose second end forms a second hinging element which can be removably inserted into a second recess made in the bottom, the second recess being such that, when the second means are used for hinging, the lid can pivot through at least 90° with respect to the bottom.

Advantageously, the first and second members are molded with the bottom and with the lid, respectively. Thus the casing, including the hinging and locking systems, consists only of two parts. Thus, a make-up case is obtained which has at least two hinges which can be selectively separated by the pulling force exerted in a direction approximately orthogonal to the plane of the case separating the bottom from the lid. For example, when two hinging elements are provided on opposite ends of the case, one of the hinging elements is dislodged by the pulling force from its housing acting as a clasp; the other hinging element turns in its associated housing, acting as a hinge. Of course, the opening operation may be performed in reverse.

The first and second hinging elements may be in the form of a ball or a pivot pin. According to a specific embodiment, the first end of the first member is in the form of a first ball which can be inserted into a second recess made in the bottom, opposite the first, the second recess being such that, when the first means are used for hinging the lid to the bottom, the lid can pivot through 360° with respect to the bottom. Likewise, the first end of the second member is in the form of a second ball which can be inserted into a second recess made in the lid, opposite the first, the second recess being such that, when the second means are used for hinging the lid to the bottom, the lid can pivot through 360° with respect to the bottom.

Advantageously, each recess is bounded by two lateral edges, at least one of the lateral edges being elastically deformable so as to be able to accommodate, by reversible snap-fastening, a corresponding ball or hinge pin.

According to an advantageous embodiment, at least one of the lateral edges forms an elastically deformable tongue.

In practice, it is advantageous to produce two tongues located on each side of the ball. The elasticity of the tongues is preferably chosen so that the lid keeps its position whatever its orientation in the open position.

In order to make it easier to open the case on one side or the other, the way in which the ball(s) or the hinge pin(s) is(are) held in the recess(es) of the bottom may differ from that of the ball(s) in the recess(es) of the lid. This may be achieved by balls of slightly different diameter, by a pair of tongues which are further apart or closer together, or by tongues of different flexibility. In this way, it is also possible to orient the lid, in a stable manner, in a desired position.

According to a preferred embodiment of the invention, the bottom has two main faces and a lateral edge, the recess(es) made in the bottom both emerging on at least one of the two main faces and on the lateral edge. The lid has two main faces and a lateral edge, the recess(es) made in the lid both emerging on at least one of the two main faces and on the lateral edge. When a recess emerges on the lateral edge and on one of the main faces (in this case, the internal face), pivoting through 90° is possible. When a recess emerges on the lateral edge and on the two main faces, pivoting through 180° is possible.

Advantageously, the lid and the bottom are molded from a rigid or semi-rigid thermoplastic, such as polypropylene, PVC (polyvinyl chloride), polycarbonates, polyesters, styrene plastics such as acrylonitrile-butadiene-styrene (ABS) and styrene-acrylonitrile (SAN) copolymers and polystyrenes (PS), etc.

In order to be able to house a product in the case, the bottom advantageously defines a first housing intended to accommodate the product in the form of a powder or a paste. Likewise, the lid may define a second housing, identical to the first, in order to accommodate an applicator and/or a mirror.

Furthermore, the case may include means for making it easier to open the case, for example gripping tabs located, in the closed position of the case, near the ball on the lateral edge of the bottom and/or on the lateral edge of the lid.

In addition, means for indexing the angle of opening of the lid with respect to the bottom may be provided. Thus, a region of the lateral edge of the lid and/or of the bottom may be beveled. Thus, apart from a preferred opening position at 90° and at 180°, an additional preferred position, for example at 120°, may be provided, this being advantageous when the user wishes to lay the case on a make-up table and to use the mirror. It should be noted that according to certain embodiments, whatever the angle of opening of the lid with respect to the bottom in the range from 90° to 180°, the lid can be rotated through 360° about an axis intercepting a plane defined by the bottom, thereby allowing the mirror to be oriented in any desired position.

According to a preferred embodiment of the invention, the external shape of the case, in the closed position, is generally that of a cylindrical disc of circular or oval cross-section. However, it is possible to produce cases of parallelepipedal external general shape or cases whose cross-section is prismatic, polygonal or trapezoidal, etc.

According to the invention, a case comprises a bottom; a lid, wherein said bottom and said lid are formed from molded parts; and two snap fit joint structures cooperating with opposite portions of the bottom and of the lid for releasably joining said bottom and said lid such that said lid may be pivotally joined to said bottom by one of said joint structures and said bottom and lid may be secured in a closed position by both of said joint structures.

One of said two joint structures comprises a first member mounted to one of said bottom and said lid, said first member having a pivot joint part, and a cooperating part in the other of said bottom and said lid, said pivot joint part and said cooperating part being cooperable to form a pivot joint permitting pivoting by an angle of at least 90°. The other of said two joint structures comprises a second member mounted to the other of said bottom and said lid, said second member having a pivot joint part, and a cooperating part in the one of said bottom and said lid, said pivot joint part and said cooperating part being cooperable to form a pivot joint permitting pivoting by an angle of at least 90°.

BRIEF DESCRIPTION OF THE DRAWINGS

In the description which follows, reference will be made to the drawings in which.

DETAILED DESCRIPTION OF THE PREFERRED EMBODIMENT

Figure 1:
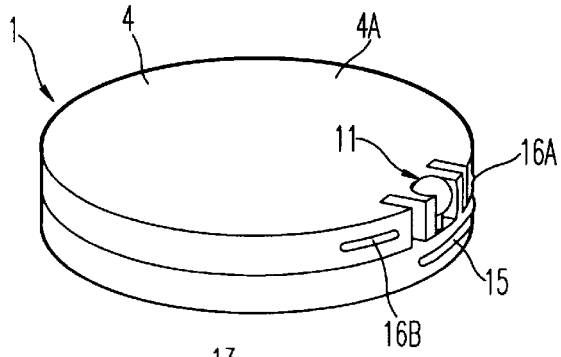
FIG. 1 shows a first embodiment of the case according to the present invention in the closed position.

As shown in FIGS. 1 to 6, the case 1 according to a first embodiment of the invention has a bottom 2 which defines a receptacle for a product P (see FIG. 2) such as a make-up product. In the embodiment shown, the bottom 2 defines a first housing 3 intended to accommodate, for example, a foundation or a compacted powder. A lid 4 is hinged to the bottom 2 by means of a snap fit joint structure including a first ball 5. The ball 5 has a free end in the form of a pivot joint part or spherical portion 6 connected to the lid by a stem 7 (see FIG. 3). The bottom 2 has snap-fastening cooperating part 8 for elastically snap-fastening the ball 5 in a recess 9.

The recess 9 emerges on the main faces 2*a* and 2*b* of the bottom, and on the lateral face 2*c*. The recess 9 is laterally bounded by two tongues 9*a* and 9*b* which are able to flex so as to exert an elastic gripping force on the ball 5 fitted into the housing 9. The elasticity of the two tongues 9*a* and 9*b* derives from the presence of two slots 10*a* and 10*b*.

The lid 4 defines another housing 6 intended to contain a mirror M or an applicator such as a powderpuff (not shown).

A second ball 11 of another snap fit joint structure is located on the internal main face 2*b* of the bottom 2, diametrically opposite the recess 9, the second ball having a free end 18 of spherical shape and of geometry similar to that of the first ball 5, and being integral with the bottom via a stem 12. The second ball 11 is capable of being housed in a second cooperating recess 13 in the lid 4 opposite the ball 5. The second recess 13, of geometry similar to that of the recess 9, is bounded by two lateral tongues 13*a*, 13*b* which are laterally elastically deformable by virtue of the presence of two slots 14*a* and 14*b*. The recess 13 emerges on the main faces 4*a* and 4*b* of the lid, and on its lateral face 4*c*.

Figure 2:
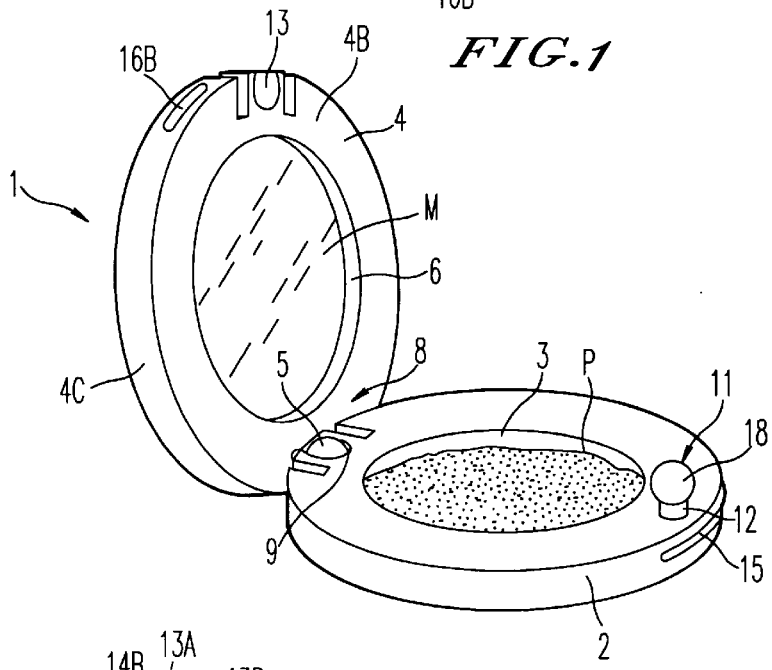
FIG. 2 shows the case in FIG. 1 in a position opened to approximately 120°.
Figure 3:
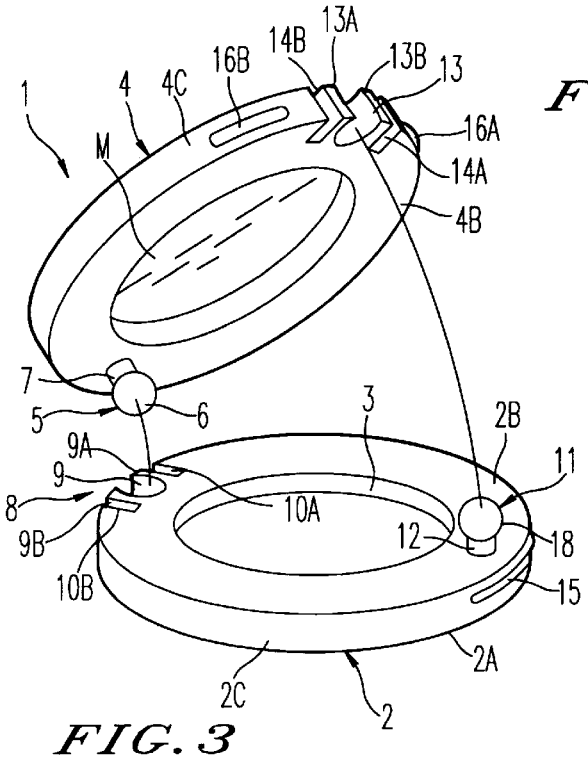
FIG. 3 shows the case in FIG. 1 during the assembly phase.

FIG. 3 illustrates the process of assembling the case. The ball 5 is snap-fastened into the housing 9. The case as shown in FIG. 2, in the position opened to 90°, is then obtained. By pivoting the lid 4 towards the bottom 2, the ball 11 may be snap-fastened into the housing 13. The case is thus closed, as shown in FIG. 1.

Figure 4:
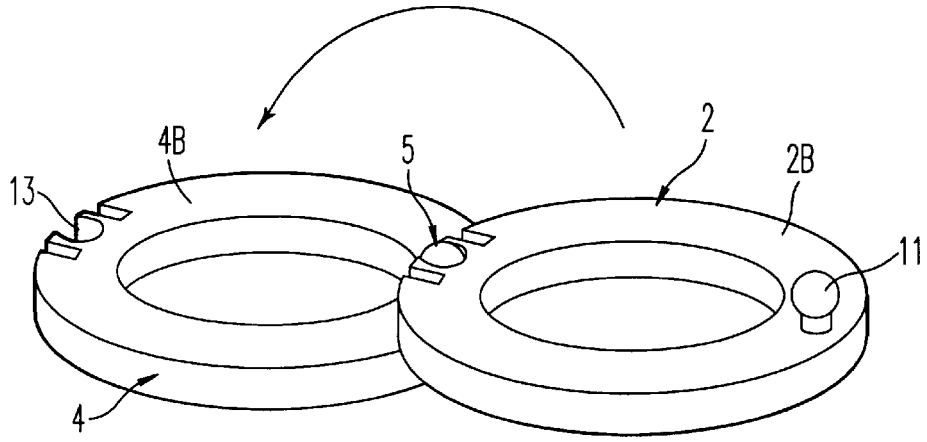
FIG. 4 shows the case in FIG. 1 in the position opened to approximately 180°.

In order to make it easier to open the case, a first gripping profile 15 has been made on the lateral edges 2*c*, 4*c* of the bottom and the lid, near the ball. Likewise, two portions of a second profile 16*a* and 16*b* have been made on the lateral edges 2*c*, 4*c* of the bottom and the lid, on each side of the recesses 9 and 13. By pressing against the profiles 15 and 16*a*, 16*b*, on one side of the case, it is possible to open the case. By pivoting the lid in a position at approximately 120°, the arrangement as shown in FIG. 2 is obtained. By continuing to open the case in the same direction, by pivoting through 180°, the completely open position shown in FIG. 4 is obtained.

Figure 5:
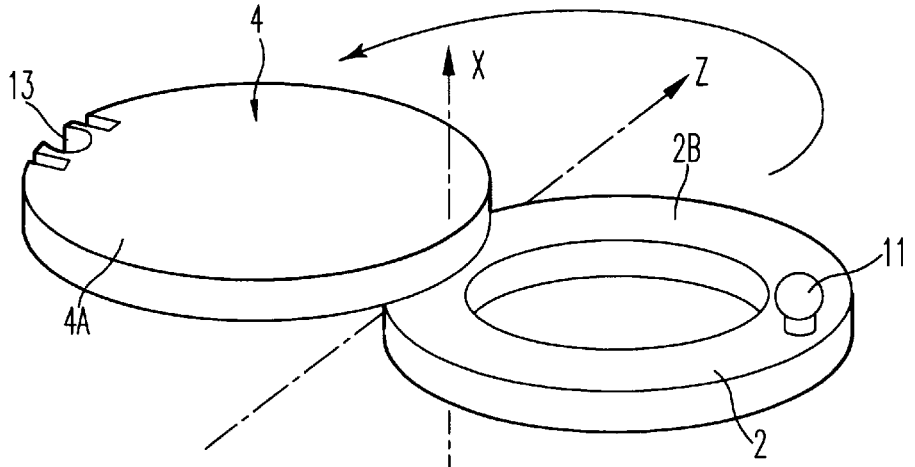
FIG. 5 shows the case in FIG. 4 in the position opened to approximately 180°, the lid having been rotated.
Figure 6:
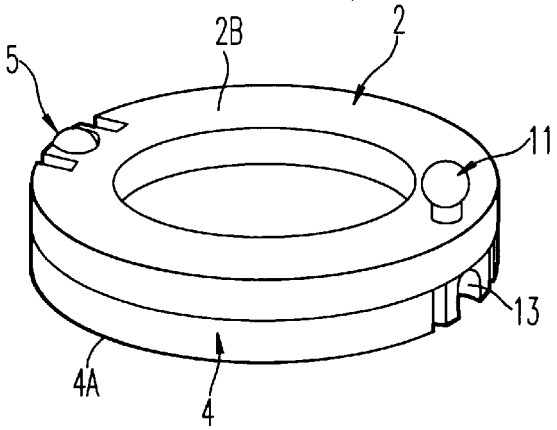
FIG. 6 shows the case in FIG. 1 in the position opened to 180°, the lid being placed beneath the bottom.

The configuration shown in FIG. 5 is obtained after having half-opened the case, by rotating the lid through 180° about an axis X, perpendicular to a plane defined by the bottom 2 and passing through the ball 5. Starting from the position shown in FIG. 5, it is possible to obtain the configuration shown in FIG. 6, in which the lid lies beneath the bottom, by pivoting through 180° about an axis Z perpendicular to the axis X.

Figure 7:
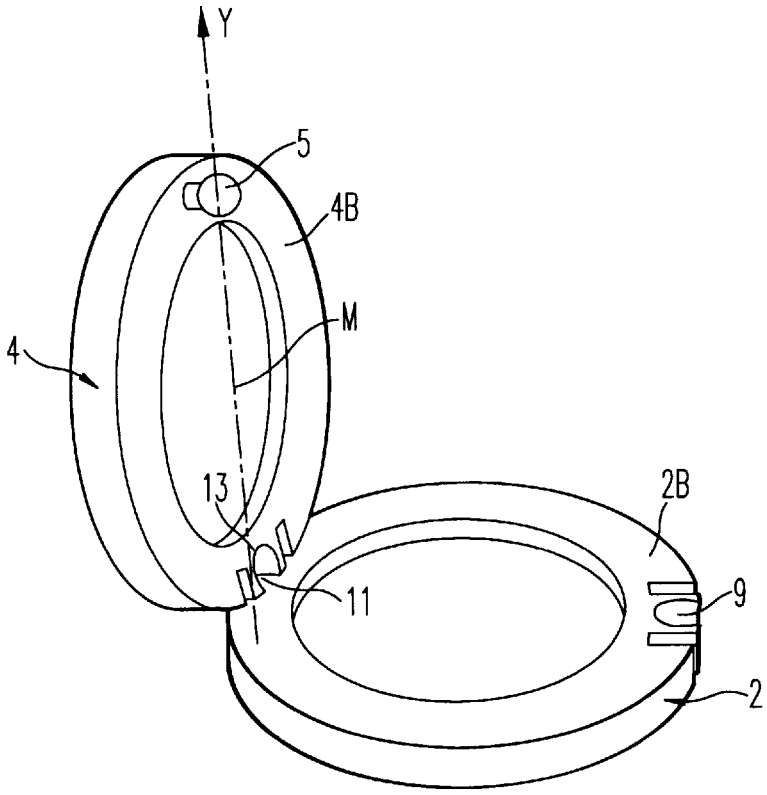
FIG. 7 shows the case in FIG. 1, in the reversed opening position.

FIG. 7 shows a view of the case in FIG. 1 in the reverse position, i.e. opening has been obtained by disengaging the ball 5 from the recess 9. Consequently, the ball 11, which acts as a hinge lies on the internal main face 2*b* of the bottom 2. In this position, the lid, and therefore the mirror M, may be oriented, as required, at any angle from 0° to 360° about an axis Y approximately perpendicular to the plane defined by the bottom 2 and passing through the ball 11.

Figure 8:
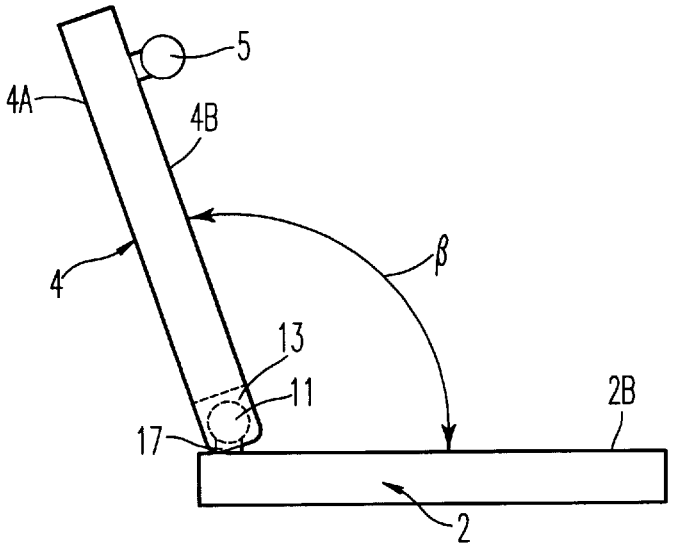
FIG. 8 shows a side view of another embodiment of the invention.

FIG. 8 shows a side view of another embodiment, in which a region 17, located on the lid 4 near the recess 13, has a bevel. Compared with the external face 4*a* of the lid, this bevel makes an angle of approximately 45°. Thus, a positioned opening angle β of approximately 135° may be obtained.

Figure 9:
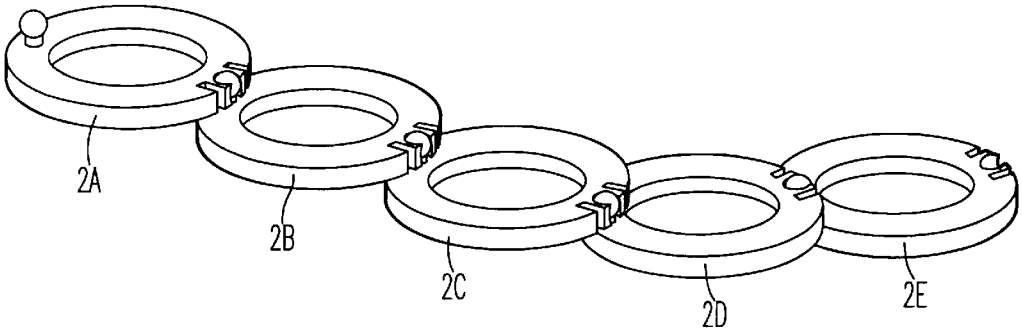
FIG. 9 shows the bottom of five different cases similar to that shown in FIG. 1, the bottoms being joined together for display purposes.

FIG. 9 shows a series of five case bottoms 2*a*–2*e* joined together for display in a display cabinet in a sales area.

Figure 10:
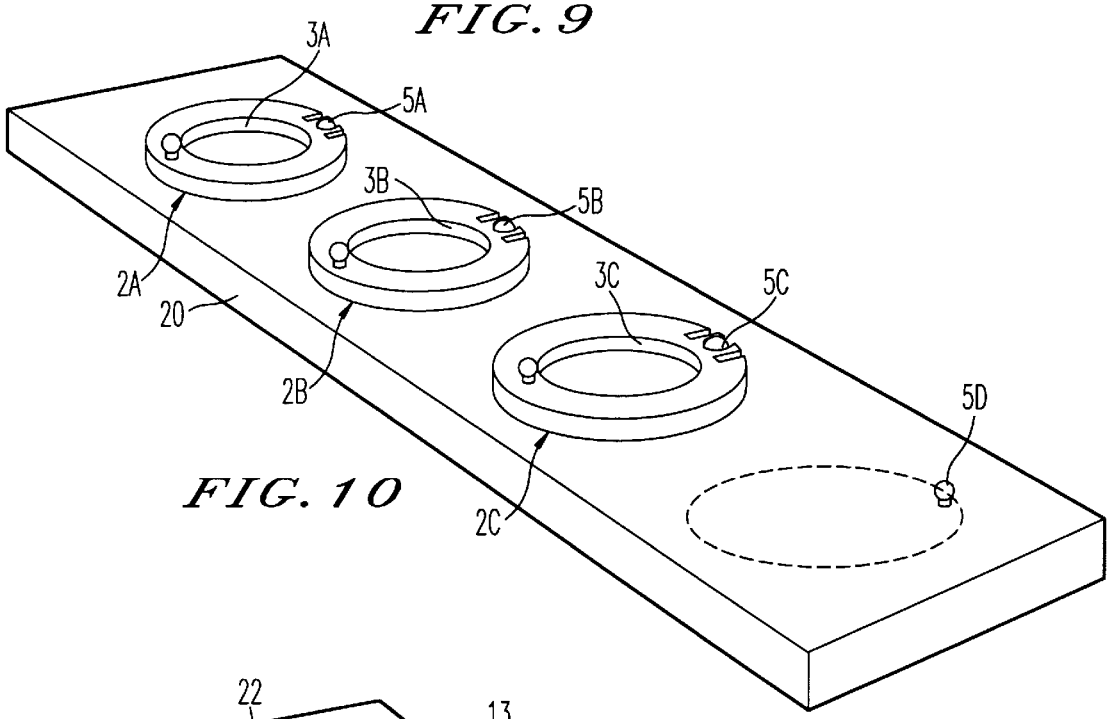
FIG. 10 shows three case bottoms similar to that shown in FIG. 1, these being fixed to a packaging support.

FIG. 10 shows a packaging support 20 provided with a series of balls 5*a*–5*d*. These balls serve as means of fixing a series of bottoms 2*a*–2*c*, for the purpose of filling their respective housings 3*a*–3*c* with a product.

Figure 11:
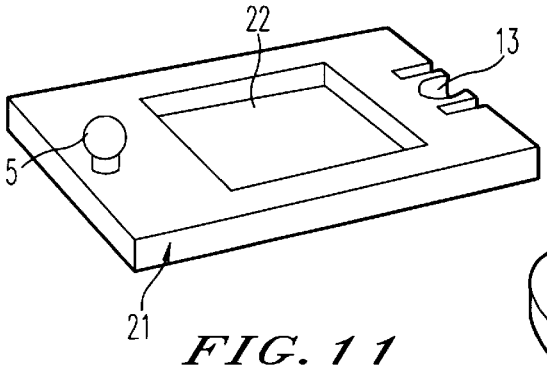
FIGS. 11 to 13 show three other embodiments of a case according to the invention.
Figure 12:
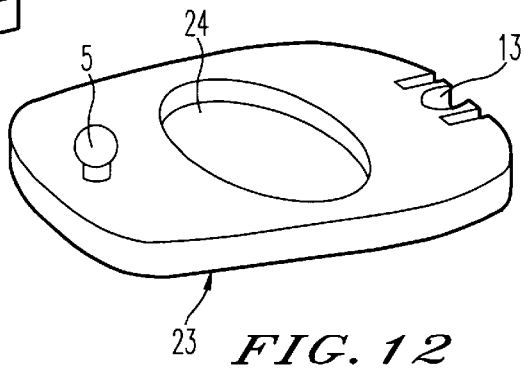

FIGS. 11 and 12 illustrate two other embodiments of the case of the invention. According to the embodiment in FIG. 11, a bottom (or lid) 21 has a rectangular shape having a housing 22 also of rectangular shape. According to the embodiment shown in FIG. 12, a case bottom 23 has an approximately oval shape and is provided with a housing 24 also of oval shape.

Figure 13:
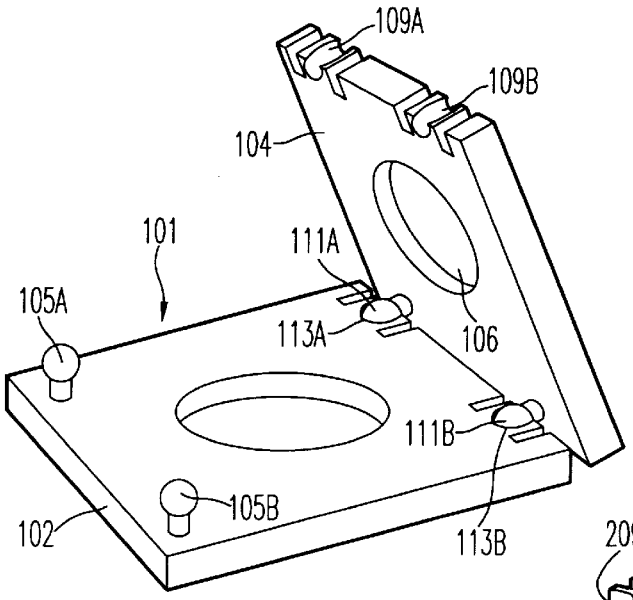

FIG. 13 shows another embodiment of a case 101, which has a rectangular bottom 102 and a lid 104 of identical shape. The bottom 102 has two balls 105*a*, 105*b* located near two adjacent corners. Two recesses 113*a*, 113*b* are provided on the side opposite the balls, these recesses being for accommodating balls 111*a*, 111*b* integral with the lid 104. The lid 104 likewise has two recesses 109*a*, 109*b* which can engage with the balls 105*a*, 105*b* carried by the bottom. In this case, a pair of balls 105*a*, 105*b* or 111*a*, 111*b* may act as a pivoting hinge or as a clasp.

Figure 14:
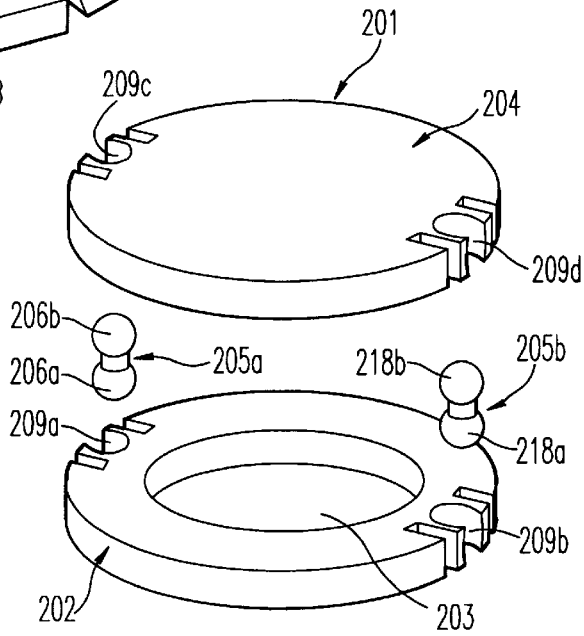
FIG. 14 shows another embodiment of a case according to the invention.

FIG. 14 shows a case 201 of circular cross-section, consisting of a bottom 202 and a lid 204 of identical shapes. The bottom and the lid are provided, respectively, with two diametrically opposed recesses 209*a*–209*b* and 209*c*–209*d*, respectively. The bottom and the lid are fitted together by means of a pair of dumbbells 205*a* and 205*b* each having two balls, 206*a*, 206*b* and 218*a*, 218*b*, respectively, which are connected by a stem. Thus, in the closed position of the case, the balls 206*a* and 218*a* are engaged in the recesses 209*a* and 209*b* of the bottom, and likewise the balls 206*b* and 218*b* are in engaged in the recesses 209*c* and 209*d*, respectively, of the lid 204. With such an embodiment, it is possible to pivot the lid with respect to the bottom through an angle which may range up to 360°. One of the two balls of each dumbbell may be held in its corresponding recess more tightly than the other so as to avoid the dumbbell separating from both the bottom and the lid when opening the case.

Figure 15:
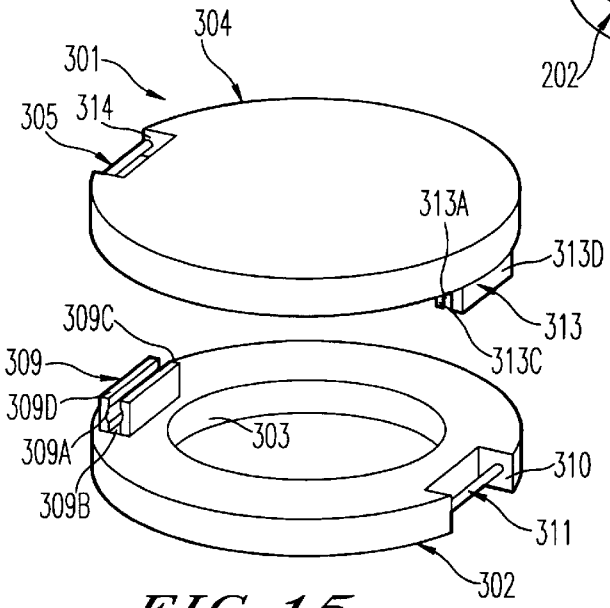
FIG. 15 shows yet another embodiment of a case according to the invention.

FIG. 15 shows another embodiment, in which a make-up case 301 consists of a bottom 302 and a lid 304 which are substantially circular. The bottom and the lid are of identical structure. The bottom has a housing 303 intended to accommodate a make-up powder. The bottom 302 is provided with snap fit joint structures including an indent 310 across which passes a hinge pin 311. Mounted on the internal face of the bottom, on the side, opposite the indent 310, is a snap-fastening pivot joint element 309 intended to accommodate, by snap-fastening, a cooperating hinge pin 305 carried by the lid 304 and placed in an indent 314 of the lid. The snap-fastening element 309 consists of two elastically deformable parallel tabs 309*c* and 309*d* separated by a slot 309*b*. A cylindrical housing 309*a* is cut out in the slot 309*b*, the size of this cylindrical housing being chosen so that the hinge pin 305 can be housed inside the housing 309*a* and gripped lightly, by snap-fastening. Likewise, the lid 304 has a snap-fastening element 313 formed by two parallel tabs 313*c* and 313*d* which are also elastically deformable and have a cylindrical housing 313*a* intended to accommodate, when closing the case, the hinge pin 311 of the bottom 302. In order to open, this case, all that is required is to exert a slight pulling force so as to move the bottom away from the lid, or the lid away from the bottom, on the side containing the pin 305 (or, if required, on the opposite side, facing the pin 311). While exerting the pulling force, the tabs 309*c* and 309*d* defining the housing 309*a* move slightly apart and the hinge pin 305 can leave via the open end of the slot 309*b* by pivoting about the axis of the pin 311. By moving the bottom away from the lid, the latter may be positioned at an angle of opening which can range up to approximately 180° with respect to the bottom.

It should be noted that, in the case of FIGS. 1 to 13, the balls may be integrally molded with the bottom or the lid. The material used for producing these parts is a rigid or semi-rigid thermoplastic, for example polypropylenes, PVC (polyvinyl chloride), polycarbonates, polyesters, styrene plastics such as acrylonitrile-butadiene-styrene (ABS) or styrene-acrylonitrile (SAN) copolymers and polystyrenes (PS), etc.

The above description makes reference to preferred embodiments of the invention. It is obvious that variants thereof may be made without departing from the scope of the invention as claimed hereinbelow.

I claim:

1. A case comprising:

a bottom including a snap fit joint structure;

a lid including a snap fit joint structure, wherein said bottom and said lid are formed from identical molded parts; and where the two snap fit joint structures cooperate with opposite portions of the bottom and of the lid for releasably joining said bottom and said lid such that said lid may be pivotally joined to said bottom by either one of said joint structures, and said bottom and lid may be secured in a closed position by both of said joint structures.

2. The case according to claim 1, wherein the bottom defines a first housing accommodating a cosmetic product, the lid defining a second housing, identical to the first housing and accommodating an applicator.

3. The case according to claim 1, further comprising means for making it easier to open the case.

4. The case according to claim 1, wherein each of said two snap fit joint structures comprises a member having two male parts pivotally mountable to cooperating female parts in said bottom and said lid.

5. The case according to claim 1, wherein the bottom defines a first housing accommodating a cosmetic product, the lid defining a second housing, identical to the first housing and accommodating a mirror.

6. The case according to claim 1, wherein one of said two joint structures comprises a first member mounted to one of said bottom and said lid, said first member having a pivot joint part, and a cooperating part in the other of said bottom and said lid, said pivot joint part and said cooperating part being cooperable to form a pivot joint permitting pivoting by an angle of at least 90°; and wherein the other of said two joint structures comprises a second member mounted to the other of said bottom and said lid, said second member having a pivot joint part, and a cooperating part in the one of said bottom and said lid, said pivot joint part and said cooperating part being cooperable to form a pivot joint permitting pivoting by an angle of at least 90°.

7. The case according to claim 6, wherein said first and second members are molded with the bottom and with the lid, respectively.

8. A case comprising:

a bottom;

a lid, wherein said bottom and said lid are substantially identical and are formed from molded parts; and two snap fit joint structures cooperating with opposite portions of the bottom and of the lid for releasably joining said bottom and said lid such that said lid may be pivotally joined to said bottom by one of said joint structures, and said bottom and lid may be secured in a closed position by both of said joint structures, wherein said snap fit joint structures each comprises a ball and a recess having elastically deformable walls to permit pivoting at the joint structures about plural axes.

9. The case according to claim 8, wherein said elastically deformable walls of said recess are comprised by tongues.

10. The case according to claim 8, wherein said recesses each emerge to top bottom and lateral edges of the respective bottom and lid.

* * * * *